US005462182A

United States Patent [19]

Opresco

[11] Patent Number: 5,462,182

[45] Date of Patent: Oct. 31, 1995

[54] SCREWS-ON CHILD RESISTANT CONSUMER-FRIENDLY CLOSURE

[75] Inventor: Ovidiu Opresco, New York, N.Y.

[73] Assignee: Weatherchem Corporation, Twinsburg, Ohio

[21] Appl. No.: 188,395

[22] Filed: Jan. 27, 1994

[51] Int. Cl.[6] ..... B65D 55/02

[52] U.S. Cl. ..... 215/216; 215/217; 215/220

[58] Field of Search ..... 215/201, 213, 215/214, 216, 217, 218, 225, 220

[56] References Cited

U.S. PATENT DOCUMENTS

| | | | |
|---|---|---|---|
| 3,445,022 | 5/1969 | Cilluffo | 215/216 |
| 3,830,391 | 8/1974 | Uhlig | 215/216 |
| 3,891,110 | 6/1975 | Gach | 215/216 |
| 3,894,647 | 7/1975 | Montgomery | 215/9 |
| 3,895,730 | 7/1975 | Koehne et al. | 215/216 |
| 3,900,123 | 8/1975 | Darlington | 215/216 |
| 3,939,788 | 2/1976 | Schneible | 113/121 A |
| 3,971,487 | 7/1976 | Montogomery | 215/216 |
| 3,986,626 | 10/1976 | Montgomery | 215/216 |
| 4,007,850 | 2/1977 | Beaugrand | 215/216 |
| 4,069,942 | 1/1978 | Marshall et al. | 215/216 X |
| 4,106,651 | 8/1978 | Lemons | 215/216 X |
| 4,149,646 | 4/1979 | Julian | 215/216 |
| 4,360,113 | 11/1982 | Luker | 215/216 |
| 4,427,124 | 1/1984 | Marshall et al. | 215/216 |
| 4,456,136 | 6/1984 | Palsson | 215/216 |
| 4,540,098 | 9/1985 | Luker | 215/216 |
| 4,630,743 | 12/1986 | Wright | 215/216 |
| 4,687,112 | 8/1987 | Swartzbaugh | 215/216 |
| 4,948,002 | 8/1990 | Thornock et al. | 215/221 |
| 5,082,129 | 1/1992 | Kramer | 215/221 |
| 5,165,559 | 11/1992 | Kusz | 215/216 |
| 5,230,433 | 7/1993 | Hamilton et al. | 215/221 |

*Primary Examiner*—Allan N. Shoap
*Assistant Examiner*—Nathan J. Newhouse
*Attorney, Agent, or Firm*—Pearne, Gordon, McCoy & Granger

[57] ABSTRACT

A child resistant closure or cap for use on a container having a threaded, shouldered neck is disclosed. Complimentary locking means on the cap and container shoulder and a resilient release tab are provided. In one embodiment the cap includes an internally threaded cylindrically-shaped skirt having a radially extending flange portion at a bottom edge. The container shoulder has a recess formed therein and is adapted to be adjacent the cap flange portion when the cap is fully threaded onto the container neck. A downwardly extending protrusion is formed on a bottom surface of the flange portion and cooperatively engages the recess when the cap is fully threaded onto the container neck to prevent rotational removal of the cap. The protrusion is located on the resilient release tab which is formed by a circumferential slit and a perpendicular slit, whereby the release tab is upwardly or axially deflectable to disengage the protrusion from the recess and permit rotational removal of the cap. In another embodiment, the cap has a lower edge in which a release tab is arranged to be operated radially for engagement and release.

6 Claims, 3 Drawing Sheets

Fig.3
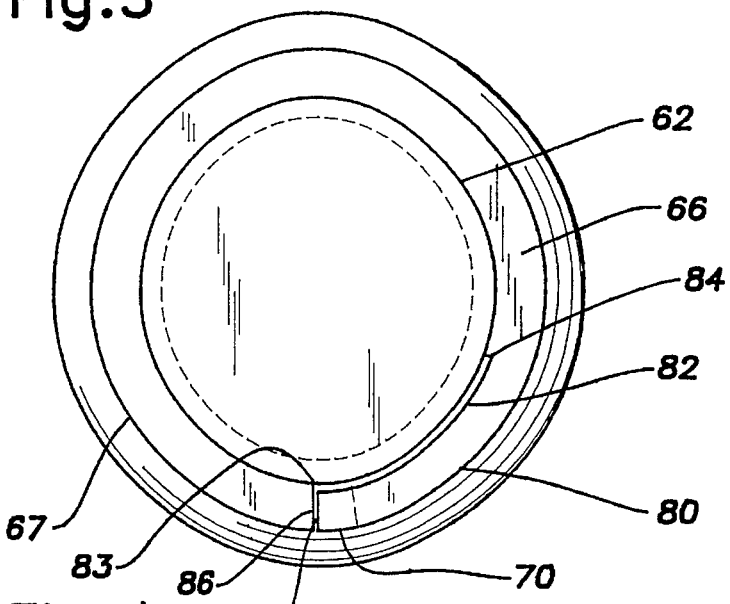
Fig.4
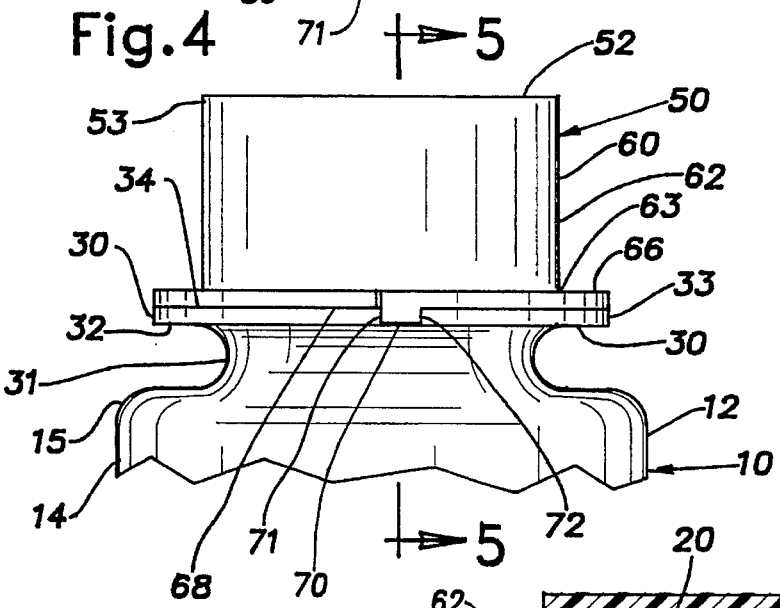
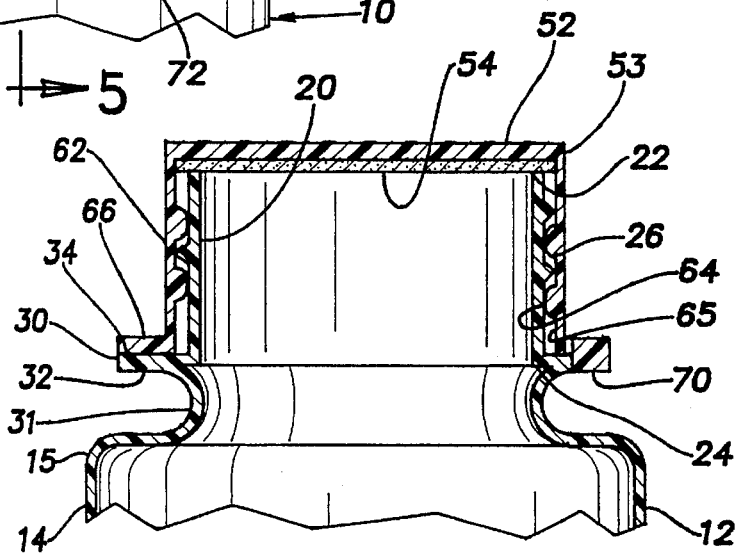
Fig.5

SCREWS-ON CHILD RESISTANT CONSUMER-FRIENDLY CLOSURE

BACKGROUND OF THE INVENTION

The present invention generally relates to closures for containers, and more specifically, to a self-locking closure resistant to opening by a child.

PRIOR ART

As is well known, children, particularly very young children, are attracted to containers and the challenge of opening containers. This can pose a great danger where the containers have poisonous or harmful contents, in any quantity or in the wrong dosage, because injury or even death can result if a child gains access to and ingests or otherwise contacts the container contents. Closures resistant to opening by children, therefore, are desirable, particularly in view of the dangers inherent in the household presence of consumer purchased containers of potentially poisonous and/or harmful substances such as pharmaceuticals, cleaning solutions, bleaches, detergents, drain cleaners, anti-freeze, and the like. In fact, government regulations and public concern are continually requiring more products to be packaged in containers that are resistant to being opened by children.

In general, child-resistant closures must require some type of manipulation that is beyond the ability or comprehension of a child to remove the closure from the container. At the same time, however, the removal of the closure from the container must be relatively simple for an adult or older child. If the container is too difficult to open by an adult, it is frequently left open, thus defeating the purpose of the child-resistant closure.

Closures must also be designed to provide for closing the containers by conventional capping equipment. Most packaging organizations posses capping equipment capable of placing a screw-on cap onto a container having a threaded neck. It is preferable, therefore, that the closure be of a screw-on type that can be placed upon the container by conventional capping equipment to eliminate the purchase of special machinery by producers of the containers, and packagers.

Various attempts have been made in the prior art to provide a child-resistant closure that meets the above requirements. Two piece child-resistant closures are common. The two piece closures typically include a threaded inner closure surrounded by an outer shell that freely rotates relative to the inner closure unless it is manipulated in a particular way. One piece child-resistant closures are preferred, however, over two piece closures in many applications. The one piece closures reduce cost by requiring only a single mold and eliminating the steps necessary for the assembly of two piece caps. One piece closures typically include a pair of interlocking members, one on the closure and one on a specially designed neck of the container. When the members are interlocked, rotational removal of the closure is prevented. At least one of the interlocking members is flexible to disengage the interlocking members and permit rotational removal of the closure from the container.

One piece screw-on child-resistant closures are known in the prior art. For example, U.S. Pat. No. 4,331,247 discloses a closure having a cap with a flexible pawl. The cap includes an internally threaded skirt and a integrally formed pawl. The pawl projects downwardly and outwardly as an extension of a lower edge of the cap skirt. When the cap is fully threaded on a neck of a container, a detent surface of the pawl abuts an upwardly projecting lug formed on a shoulder of the container to prevent rotational removal of the cap. A slot is formed above the pawl to provide the necessary flexibility to manually upwardly deflect the pawl past the lug and allow rotational removal of the cap. See also, U.S. Pat. Nos. 3,967,745, 3,900,123, 3,895,730, and 3,894,647 for related closures wherein a flexible tab projecting from the cap is upwardly deflectable past a lug formed on the container to allow rotational removal of the cap.

U.S. Pat. No. 4,099,639 discloses a closure including a flexible collar or shoulder formed on a container. The closure includes a cap having an internally threaded skirt forming an annular bottom end surface. The closure also includes an interfitting lug and recess on the container collar and cap end surface. When the cap is fully threaded onto the container neck, the cap end surface engages the container collar or shoulder to interengage the lug and recess and lock the cap in a fully closed position. The collar or shoulder has the necessary flexibility to be manually downwardly deflected to release the lug from the recess and allow rotational removal of the cap.

U.S. Pat. No. 3,902,620 discloses a closure including a flexible pawl formed on a container. The closure includes a cap having an internally threaded skirt and a flange having an external ratchet depending from a bottom edge of the skirt. When the cap is threaded onto the container neck, the pawl engages the cap ratchet to allow rotation of the cap in a closing direction but not in an opening direction. The pawl has the necessary flexibility to be manually deflected downwardly and outwardly to release the pawl from the cap ratchet and allow rotational removal of the cap.

The aforementioned prior art closures have locking members such as tabs, pawls or other protrusions that project radially outwardly from the cap or bottle. As a result, the locking means are visually emphasized and draw the direct attention of the child who will then try to manipulate the locking means. As a result, the closures may be required to have locking members more difficult to disengage than otherwise required. This is in direct conflict with the requirement that the closure be easily removed by an adult. Additionally, the prior art having locking members that do not project outward, are not easily disengaged to permit removal of the cap. Therefore, there is a need in the art for an improved child-resistant closure for containers. Moreover, there is a need in the art for a child-resistant closure having locking members that are easily disengaged and do not draw the attention of children.

SUMMARY OF THE INVENTION

The present invention provides a child-resistant closure or cap for a container having a threaded neck that solves the problem of locking members being visually emphasized and thus may be required to be more difficult to be physically disengaged. The disadvantages of the prior art are overcome by providing a locking means on a resilient release tab that is smoothly integrated into the closure to render it non-obvious to children yet easily disengaged by adults.

According to the invention there is provided a cap having a top wall and a cylindrically-shaped skirt depending from a periphery of the top wall. The cap skirt has internal threads and a lower edge. The internal threads of the cap skirt are adapted to cooperate with a threaded neck of a container. The container is provided with a circular shoulder adapted to be adjacent the lower edge of the cap skirt when the cap is fully threaded onto the container neck. Complimentary locking means are integrally formed with the cap skirt and the container shoulder and are adapted to cooperatively engage when the cap is fully threaded on the container neck to prevent rotational removal of the cap. The release tab of the closure is formed by a slit adjacent to and circumferentially extending from the locking means, and a slit perpendicularly extending from the first slit adjacent the respective locking means to an edge of the cap. The slits provide the necessary flexibility to easily deflect the release tab to disengage the locking means and permit rotational removal of the cap.

By smoothly integrating the resilient release tab and locking means into the cap and container shoulder, they are not visually emphasized. Because the release tab is not easily seen, it can be adapted to be easily deflected and still be effective to resist opening by a child. The circumferential and perpendicular slits provide great flexibility to the release tab while maintaining smooth integration of the release tab with the cap and container.

BRIEF DESCRIPTION OF THE DRAWINGS

The present invention will hereafter be described with reference to the drawing figures, wherein:

FIG. 3 is a plan view of the container and closure of FIG. 1;

FIG. 4 is an elevational view of the container and closure of FIG. 1;

FIG. 5 is a sectional view taken along line 5—5 in FIG. 4;

DETAILED DESCRIPTION OF THE PREFERRED EMBODIMENTS

Figure 1:
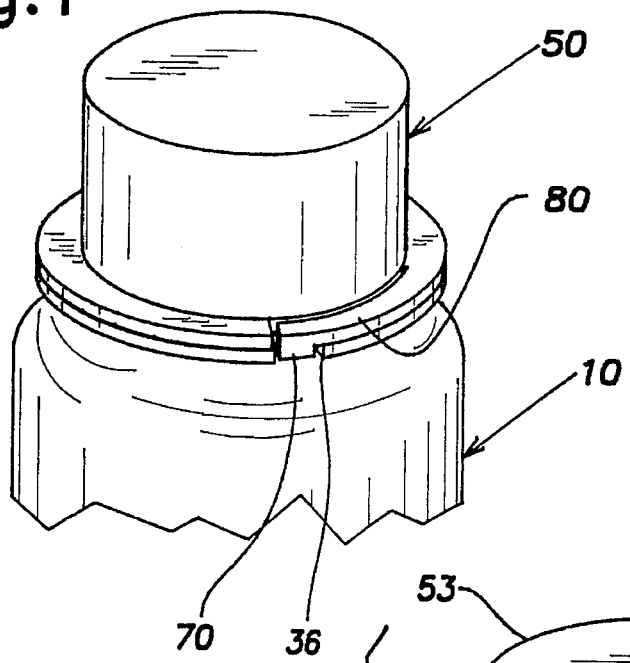
FIG. 1 is a perspective view of a portion of a container and a closure in accordance with a first embodiment of the invention.
Figure 2:
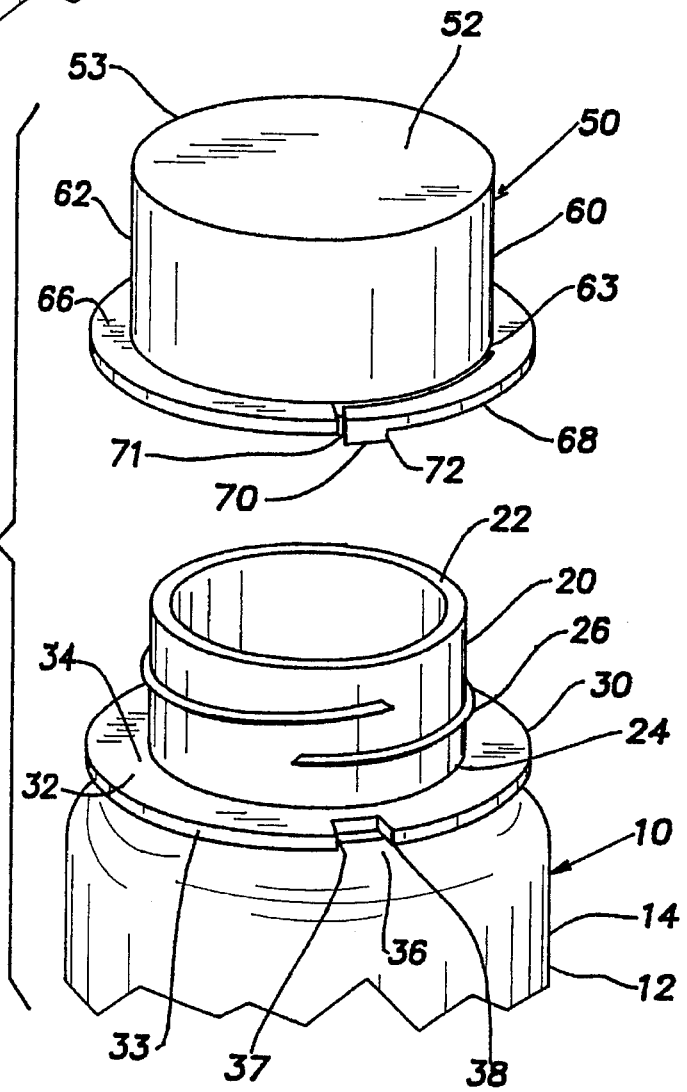
FIG. 2 is an exploded perspective view of the container and closure of FIG. 1.

Referring to the figures, and in particular FIGS. 1 and 2, there is illustrated a child-resistant closure according to the present invention. The closure or cap 50 is provided for a container 10. The cap 50 and container 10 are molded of polyethylene or other suitable thermoplastic materials common in the industry.

The container 10, as best seen in FIGS. 2, 4 and 5, comprises a body portion 12, a neck portion 20, and a shoulder 30 joining the body portion 12 and the neck portion 20. The body portion 12 is hollow and formed by a generally cylindrically-shaped side wall 14 extending from a disk-like bottom wall (not shown) as is conventional. The neck portion 20 is generally tubularly-shaped having an upper end surface 22 and lower end 24 and provided with an external screw thread 26 along its intermediate length. Preferably the external thread 26 is a right-hand type thread as is conventional in the container industry. The shoulder 30 joins the lower end 24 of the neck portion 20 to the top 15 of the body portion side wall 14.

In the preferred embodiment, the shoulder 30 is generally "u"-shaped in cross-section having a planar portion 32 and a curved portion 31. The planar portion 32 extends radially outwardly from the lower end 24 of the neck portion 20 to form an annularly-shaped planar top surface 34. The curved portion 31 extends downwardly and inwardly from the planar portion 32 then downwardly and outwardly to the top 15 of the body portion side wall 14. Formed in the planar portion 32 of the shoulder 30 is a recess or opening 36. The recess 36 is generally rectangularly-shaped having a first detent surface 37 and a second detent surface 38 and axially formed through the entire thickness of the shoulder planar portion 32. The recess 36 radially extends from a locus adjacent the container neck portion 20 to an outer periphery 33 of the shoulder planar portion 32.

The cap 50 comprises a top wall 52, and a circular skirt 60 having a tubular portion 62, a flange portion 66, and a release tab 80. The top wall 52 is generally circularly-shaped and planar or disc-like. Below the top wall 52, a liner 54 (FIG. 5) of conventional form and material is provided if desired. The skirt tubular portion 62 is generally cylindrically-shaped and depends from an outer periphery 53 of the top wall 52. An interior surface 65 of the skirt 60 has a screw thread 64 adapted to cooperate with the screw thread 26 of the container neck portion 20. Projecting radially outwardly from a lower edge 63 of the skirt tubular portion 62 is the flange portion 66. The flange portion 66 preferably has a diameter equal to or substantially equal to the diameter of the container shoulder planar portion 32.

Extending axially downwardly from a lower surface 68 of the skirt flange portion 66 is a protrusion 70. The protrusion 70 is generally rectangularly-shaped having a leading end face 71 and a trailing end face 72 and is dimensioned to cooperate with the recess 36 in the container shoulder 30. The protrusion 70 in the illustrated case extends substantially the full radial length of the skirt flange portion 66 and axially a distance substantially equal to the thickness of the planar portion 32 of the container shoulder 30. The protrusion 70 is located on a free end of the release tab 80.

The release tab 80 trails the protrusion 70 and is formed by a circumferential slit 82 and a perpendicular slit 86, as best seen in FIG. 3. The circumferential slit 82 is located on the skirt flange portion 66 adjacent to and concentric with the skirt tubular portion 62 and radially inwardly of the protrusion 70. The circumferential slit 82 extends from a first end 83 adjacent the protrusion 70 for a substantial arcuate distance in a counter-clockwise direction, when viewed from the top, to a second end 84. The perpendicular slit 86 is located adjacent the leading end face 71 of the protrusion 70 and radially extends from the circumferential slit first end 83 to an outer periphery 67 of the skirt flange portion 66. The release tab 80 in the area of the protrusion 70, because of the slits 82 and 86 forming it, is free of direct restriction by the skirt tubular portion 62 and adjacent parts of the flange portion 66 and in the manner of a cantilever is resiliently flexible so that the protrusion 70 can be manually upwardly deflected above the top surface 34 of the shoulder planar portion 32. The arcuate distance of the circumferential slit 82 is sized to provide the release tab 80 with adequate flexibility.

The cap 50 is threaded onto the container neck portion 20 by rotating it in a clockwise direction, when viewed from the top, thereby engaging the two threads 26, 64. Rotation of the cap 50 is continued until the upper end surface 22 of the container neck portion 20 engages the cap liner 54 to seal the container 10. The threads 26, 64 are arranged such that the container 10 is sealed when the cap protrusion 70 engages and is received in the container shoulder recess 36. Further rotation of the cap 50 is prevented by the leading end face 71 of the protrusion 70 engaging the first detent surface 37 of the recess 36. Rotational removal of the cap 50 is prevented by the trailing end face 72 of the protrusion 70 engaging the second detent surface 38 of the recess 36.

To remove the cap 50, the container 10 is held in one hand with a finger or thumb deflecting the protrusion 70 out of engagement with the recess 36 while the other hand rotates the cap 50 in a counter-clockwise direction, while viewed from the top, until the protrusion 70 is rotated beyond the recess 36. The protrusion 70 is then released and rotation of the cap 50 continues until the threads 26, 64 are disengaged. When desired, the cap 50 is reinstalled in the above described manner.

It will be observed that the release tab 80 can alternatively be formed leading the protrusion 70. In this alternative arrangement the circumferential slit extends from a first end adjacent the protrusion 70 in a clockwise direction, when viewed from the top, to a second end, and the perpendicular slit is located adjacent the trailing end face 72 of the protrusion.

It will also be observed that other configurations of the complimentary locking means, the recess 36 and protrusion 70, are equivalents that can be utilized. For example, but not limited to, these other configurations can include complimentary locking means of other geometries, such as cylindrically-shaped, other sizes, such as the protrusion axially extending a distance greater than the thickness of the shoulder planar portion 32 or the recess extending a distance less than the thickness of the shoulder planar portion 32, or other locations, such as the protrusion located on the container and the recess located on the cap.

It will further be observed that the cap skirt 60 can have a second flange portion projecting radially outwardly from the skirt tubular portion 62 above the flange portion 66. The addition of the second flange portion will further reduce the visibility of the release tab to a child. The second flange must be positioned sufficiently above the flange portion 66 so that the release tab can be upwardly deflectable to release the protrusion 70 from the recess 36.

Figure 6:
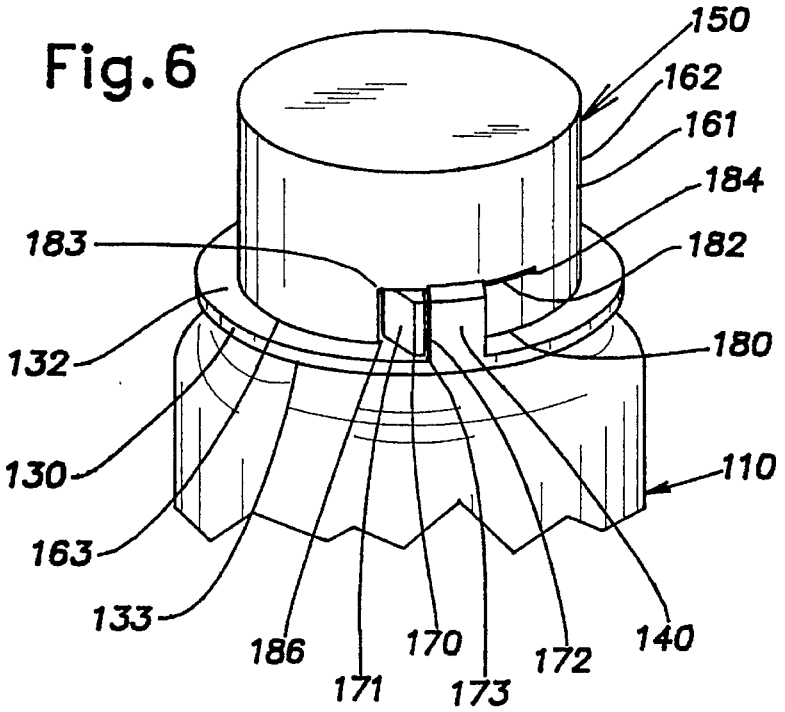
FIG. 6 is a perspective view of a portion of a container and a closure in accordance with a second embodiment of the invention.
Figure 7:
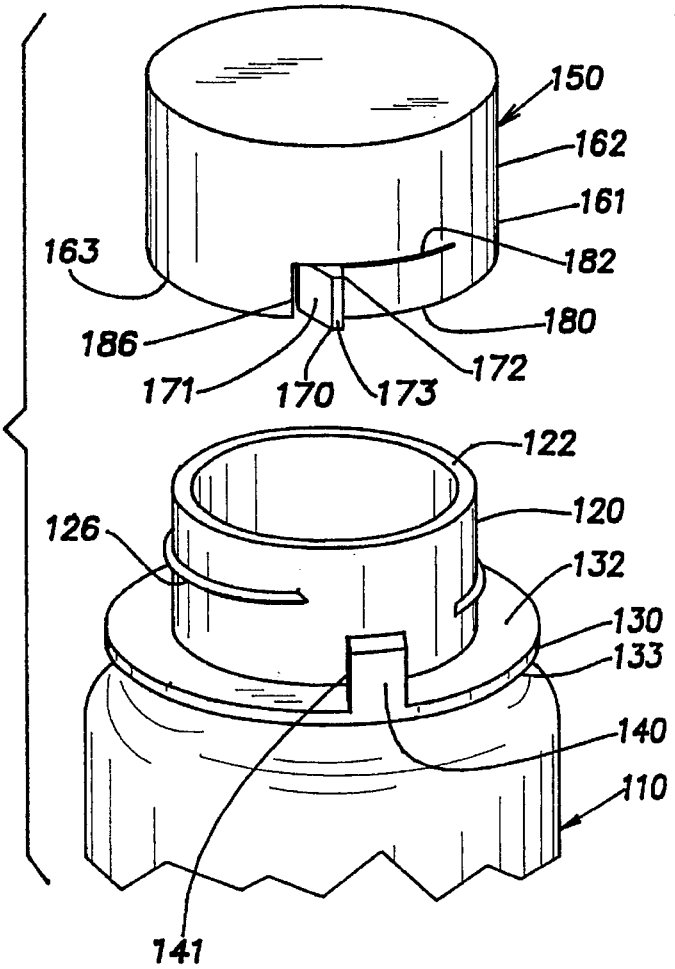
FIG. 7 is an exploded perspective view of the container and closure of FIG. 6.

In an alternative embodiment of the invention, shown in FIGS. 6 and 7, the release tab 180 is radially inwardly deflectable for removal the cap 150 from the container 110. In this alternative embodiment, a protrusion 170 extends radially outwardly from an outer surface 161 of the skirt tubular portion 162 for a distance substantially equal to the radial height of the container thread 126. The protrusion 170 has a leading end face 171 that tapers radially inwardly to the outer surface 161 of the skirt tubular portion 162. A trailing end face 172 of the protrusion 170 is generally perpendicular to the skirt tubular portion 162. The protrusion is located on a free end of the release tab 180.

The release tab 180 is formed in the skirt tubular portion 162 by a circumferential slit 182 and a perpendicular slit 186. The circumferential slit 182 is located on the skirt tubular portion 162 axially above the protrusion 170 and extending from a first end 183 adjacent the protrusion 170 for a substantial arcuate distance, in a counter-clockwise direction, when viewed from the top, to a second end 184. The perpendicular slit 186 is located adjacent the leading end face 171 of the protrusion 170 and axially extends from the circumferential slit first end 183 to the lower edge 163 of the skirt tubular portion 162.

An element 140 projects axially upwardly from the planar portion 132 of the container shoulder 130. The element 140 is generally rectangularly-shaped having a detent surface 141 and extending radially inwardly from the outer periphery 133 of the shoulder planar portion 132 to a point adjacent the outer surface 161 of the cap skirt tubular portion 162 when the cap 150 is installed. Preferably, an outer surface 173 of the protrusion 170 is proportioned to be substantially flush with the outer periphery 133 of the shoulder planar portion 132. The container thread 126 is interrupted for a circumferential distance substantially equal to the circumferential length of the release tab 180.

When the cap 150 is threaded onto the container neck portion 120, rotation is continued until the upper end surface 122 of the container neck portion 120 engages the cap liner (not shown) to seal the container 110. The threads are arranged such that when the container 110 is sealed, the trailing end face 172 of the protrusion 170 is adjacent the detent surface 141 of the element 140. As the cap 150 is rotated onto the container neck portion 120, the tapered leading end face 171 of the protrusion 170 engages the container shoulder element 140 and cams the release tab 180 radially inwardly. Once the protrusion 170 is rotated beyond the container shoulder element 140, the release tab 180 resiliently deflects radially outwardly until the protrusion trailing end face 172 is adjacent the element detent surface 141. Rotational removal of the cap 150 is prevented by the trailing end face 172 engaging the element detent surface 141.

To remove the cap 150, the container 110 is held in one hand with a finger or thumb deflecting the cap protrusion 170 out of engagement with the container shoulder element 140 while the other hand rotates the cap 150 in a counter-clockwise direction, while viewed from the top, until the protrusion 170 is rotated beyond the element 180. The protrusion 170 is then released and rotation of the cap 150 continues until the threads are disengaged. When desired, the cap 150 is reinstalled in the above described manner.

It will be observed that other configurations of the cap skirt 160, such as a skirt having concentric tubular portions or a vertical flange portion, are alternatives for the above described cap skirt with a radially inwardly deflectable release tab. Such a skirt having concentric tubular portions has an inner tubular portion with an internal thread, and an outer tubular portion adequately spaced from the inner tubular portion allowing the release tab to be radially inwardly deflectable to disengage the locking means. Alternatively, a vertical flange portion has a top wall extending from the lower edge of the skirt tubular portion, and a cylindrically shaped wall depending from an outer periphery of the top wall and forming the protrusion and release tab.

Although particular embodiments of the invention have been described in detail, it will be understood that the invention is not limited correspondingly in scope, but includes all changes and modifications coming within the spirit and terms of the claims appended hereto.

What is claimed is:

1. A child resistant closure cap for a container having a threaded neck thereon, said cap having a top wall and a generally cylindrically-shaped skirt depending from a periphery of said top wall, said cap skirt having a lower edge and an internal screw thread formed for cooperation with the threaded neck of said container, locking means integrally formed with said cap skirt and adapted for being cooperatively engaged with complementary locking means of the container when said cap is fully threaded onto the container neck to prevent rotational removal of said cap, and a resilient release tab formed by a first slit in the lower edge of the cap skirt adjacent to and circumferentially extending from said locking means for a substantial arcuate distance and a second slit in the lower edge of the cap skirt perpendicularly extending from said first slit adjacent said locking means, whereby said release tab is resiliently deflectable to disengage said locking means and permit rotational removal of said cap, the lower edge of said cap skirt having a radially extending flange portion, said release tab being formed by said flange portion, said second slit extending radially outwardly through said flange portion whereby said release tab is arranged to be axially deflectable, said flange portion having an outer circumference, said release tab having a radially outwardly facing surface, whereby said outwardly facing surface of said release tab being substantially coincident with said outer circumference.

2. The cap according to claim 1, wherein said skirt flange portion has a bottom surface and said locking means comprises a protrusion projecting downwardly from said bottom surface and being adapted to resiliently engage a recess on the neck of a container.

3. The cap according to claim 2, wherein said protrusion is substantially rectangularly shaped.

4. The cap according to claim 2, wherein said first slit trails said protrusion when said cap is threaded onto said container neck.

5. The cap according to claim 2, wherein said first slit leads said protrusion when said cap is threaded onto said container neck.

6. A combination comprising as one component a child resistant closure cap and as another component a container having a threaded neck thereon, said cap having a top wall and a generally cylindrically-shaped skirt depending from a periphery of said top wall, said cap skirt having a lower edge and an internal screw thread formed for cooperation with the threaded neck of said container, said container including a shoulder on said neck adapted to be adjacent said cap lower edge when said cap is fully threaded onto said container neck, said cap having a prominent diameter in the area of the cap lower edge, said cap and said container components having complimentary locking means integrally formed with said cap skirt and said container shoulder respectively and adapted for being cooperatively engaged when said cap is fully threaded onto the container neck to prevent rotational removal of the cap, said locking means being substantially radially within the prominent diameter whereby it avoids a high visual character status and thereby reduces the tendency of a child to be attracted to the locking means, a resilient release tab formed in the lower edge of said cap by a slit in a generally radial plane and a slit in a generally circumferential line whereby said release tab is resiliently axially deflectable to disengage said locking means and permit rotational removal of said cap.

* * * * *